US007954730B2

(12) United States Patent
Ng

(10) Patent No.: US 7,954,730 B2
(45) Date of Patent: Jun. 7, 2011

(54) PIEZOELECTRIC FLUID ATOMIZER APPARATUSES AND METHODS

(75) Inventor: Lap Leung Ng, Kowloon (HK)

(73) Assignee: Hong Kong Piezo Co. Ltd., Hong Kong (CN)

( * ) Notice: Subject to any disclaimer, the term of this patent is extended or adjusted under 35 U.S.C. 154(b) by 447 days.

(21) Appl. No.: 11/119,838

(22) Filed: May 2, 2005

(65) Prior Publication Data

US 2006/0243820 A1 Nov. 2, 2006

(51) Int. Cl.
*B05B 1/08* (2006.01)
*B05B 3/04* (2006.01)

(52) U.S. Cl. ..... 239/102.1; 239/102.2; 239/552; 239/556; 239/596

(58) Field of Classification Search ..... 239/102.1, 239/102.2, 552, 556; 128/200.14
See application file for complete search history.

(56) References Cited

U.S. PATENT DOCUMENTS

| | | | | |
|---|---|---|---|---|
| 3,648,929 | A | 3/1972 | Corbaz | |
| 3,901,443 | A | 8/1975 | Mitsui et al. | |
| 3,970,250 | A | 7/1976 | Drews | |
| 4,052,004 | A | 10/1977 | Martin et al. | |
| 4,085,893 | A | 4/1978 | Durley, III | |
| 4,350,838 | A | 9/1982 | Harrold | |
| 4,530,464 | A * | 7/1985 | Yamamoto et al. | 239/102.2 |
| 4,605,167 | A | 8/1986 | Maehara | |
| 4,702,418 | A | 10/1987 | Carter et al. | |
| 5,297,734 | A | 3/1994 | Toda | |
| 5,299,739 | A | 4/1994 | Takahashi et al. | |
| 5,435,282 | A * | 7/1995 | Haber et al. | 128/200.16 |
| 5,518,179 | A * | 5/1996 | Humberstone et al. | 239/102.2 |
| 5,657,926 | A | 8/1997 | Toda | |
| 5,918,593 | A | 7/1999 | Löser | |
| 6,247,525 | B1 | 6/2001 | Smith et al. | |
| 6,273,342 | B1 | 8/2001 | Terada et al. | |
| 6,382,522 | B2 | 5/2002 | Tomkins et al. | |
| 6,405,934 | B1 * | 6/2002 | Hess et al. | 239/4 |
| 6,601,777 | B2 | 8/2003 | Sun et al. | |
| 6,732,944 | B2 * | 5/2004 | Litherland et al. | 239/4 |
| 6,755,352 | B1 | 6/2004 | Toda | |

FOREIGN PATENT DOCUMENTS

| | | |
|---|---|---|
| CN | 2279221 | 4/1998 |
| CN | 1359733 | 7/2002 |
| CN | 2611051 | 4/2004 |
| JP | 60068071 | 4/1985 |
| JP | 2002166226 | 6/2002 |
| JP | 2004195432 | 7/2004 |

OTHER PUBLICATIONS

International Search Report and Written Opinion of the International Searching Authority, dated Jul. 13, 2006, prepared by The Intenational Searching Authoriy/China—PCT/CN2006/000800.

* cited by examiner

*Primary Examiner* — Dinh Q Nguyen
(74) *Attorney, Agent, or Firm* — George G. Wang; Wilkinson & Grist

(57) ABSTRACT

Piezo aerosol and ultrasonic atomizer apparatuses are disclosed. In some embodiments, a piezo aerosol apparatus may comprise a piezo component defining an opening bonded to a metal plate defining a mist reservoir. The mist reservoir may define a plurality of apertures (or holes) orientated substantially perpendicular, and the opening of the piezo component may be located above the mist reservoir. The piezo aerosol apparatus generally defines a non-symmetric compound, while the ultrasonic atomizer comprises a piezo component and metal plate of substantially the same diameter in length. Other embodiments are also claimed and disclosed.

15 Claims, 12 Drawing Sheets

PIEZOELECTRIC FLUID ATOMIZER APPARATUSES AND METHODS

TECHNICAL FIELD

The present invention relates to piezoelectric fluid atomizers. More particularly, the present invention relates to piezoelectric fluid atomizers utilizing a tunnel and plateau formation.

BACKGROUND OF THE INVENTION

Piezoelectric materials have the unusual characteristics that when subjected to a mechanical force, the materials, particularly crystalline minerals, become electrically polarized, and when the materials are subjected to an electric field, the material lengthens or shortens according to the polarity of the field and in proportion to the strength of the field. Due to these characteristics, piezoelectric materials have been used in a wide range of applications. For example, piezoelectric materials have been used in sensing applications, such as force or displacement sensors, and applications of materials with the inverse piezoelectric effect include actuation applications, such as in motors and devices that precisely control positioning, and in generating sonic and ultrasonic signals.

Piezoelectric transducers convert electrical energy into vibrational mechanical energy, such as sound or ultrasound, that is used to perform a task. Piezoelectric transducers are used to generate ultrasonic vibrations for cleaning, atomizing liquids, drilling, milling ceramics or other difficult materials, welding plastics, and medical diagnostics. One or more piezoelectric transducers can be used in an application.

Conventional atomizers typically utilize an ultrasonic vibrating component disposed at the lower extent of an atomization chamber. An electronic circuit that oscillates at an ultrasonic frequency drives the vibrating component, and the positive and negative leads of a fluid level sensor positioned along a fluid line in a liquid reservoir measures and maintains a safe volume of fluid. During operation, the ultrasonic vibrating component generates a sonic field that atomizes liquid in the reservoir. Since the liquid reservoir of a conventional atomizer is of an open design, the liquid must be maintained at a higher volume and level, with the ultrasonic vibrating component unavoidably requiring a larger sonic wave exciter surface area to generate a sonic field that is sufficient to atomize the liquid in the reservoir. As such, the design of conventional atomizers generally requires high power consumption and AC adaptors. Though atomizers may be actuated by hand operation, such atomizers are for personal use only and cannot be used to provide atomized fluids remotely. There are also other design elements that have hampered atomizer development and wider utilization in has not occurred.

What is needed are fluid atomizers that are compact, function with low power consumption, and that can be used remotely.

SUMMARY

The present invention generally comprises methods and apparatuses for providing atomized fluids. In particular, an apparatus of the present invention is compact and functions with low power consumption. Embodiments of the present invention comprise fluid atomizers that can be powered by AC current, or alternatively DC current provided by, including but not limited to, batteries and many other DC current sources. Aspects of the apparatus of the present invention may be controlled remotely. By using a timing means, the apparatus may be activated at any time to provide, for example, atomized fragrance, air freshener, or medicinal agents. Embodiments of the apparatus comprise piezoelectric atomizers comprising symmetric or nonsymmetrical piezo components. Embodiments of piezoelectric atomizers comprise a piezo component defining an opening that is bonded to a metal plate defining a mist reservoir. More specifically, the mist reservoir may define a plurality of apertures (or holes) oriented substantially perpendicular, and the opening of the piezo component may be located above the mist reservoir.

Methods of the present invention comprise providing atomized fluids using an apparatus disclosed herein. The atomic fluids may comprise fluids that affect the environment or persons or animals in the environment, including, but not limited to, fragrances, air fresheners, or medicinal agents.

Various objects, benefits and advantages of the present invention will become apparent upon reading and understanding the present specification when taken in conjunction with the appended drawings.

DETAILED DESCRIPTION OF THE INVENTION

The present invention comprises methods and apparatuses for atomizing fluids. An apparatus of the present invention comprises a piezo ceramic disc attached (or coupled) to a metal diaphragm, for example, by gluing the piezo disc to the metal. The attachment of a piezo ceramic to one side of a metal plate or diaphragm is referred to as nonsymmetrical herein. The present invention comprises fluid atomizers made with nonsymmetrical piezo components. One aspect of an apparatus of the present invention comprises a ring-shaped piezo ceramic glued onto a metallic diaphragm. Prior art nonsymmetrical piezo components comprise a smaller diameter piezo disc attached to one side of a larger diameter metallic plate or diaphragm.

An aerosol apparatus of the present invention comprises a chamber and a mist reservoir formed in a metal steel plate or diaphragm. When the nonsymmetrical component is actuated, liquid is provided through the tapered holes in the roof of the mist reservoir. The liquid is supplied to the mist reservoir or chamber from a liquid source. The liquid source can be a bottle or any other container, and the container is optionally attached to the aerosol apparatus of the present invention. The liquid in the container may be transferred from the container to the mist reservoir by means for transferring the liquid. An example of such means includes, but is not limited to, a wick. One skilled in the art will recognize that a wick is generally a piece of material that conveys liquid by capillary action. The wick may include, but is not limited to, nonwoven materials, such as a nonwoven felt, woven materials such as a cord or strand of loosely woven, twisted, or braided fibers, or any material that draws liquid, for example, from a container to the top of the wick. An aerosol apparatus may further comprise a floating washer, a holder for the floating washer, a cap, means for supplying a current to the piezo component, and optionally, means for attachment of a liquid container.

Figures 1A, 1B:
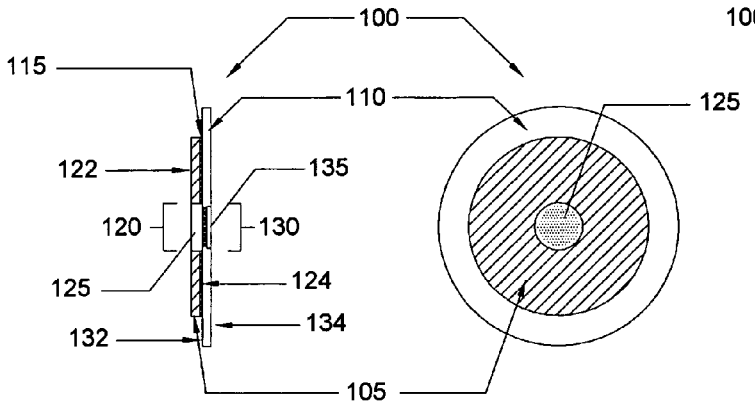
FIGS. 1A-C are diagrams of an embodiment of the present invention comprising a tunnel formation.
Figure 1C:
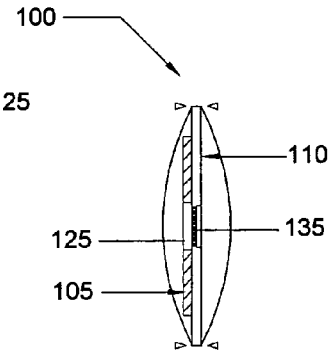

Referring now to the drawings in which like numerals represent like elements or steps throughout the several views, FIGS. 1A-C display a diagram representation of a piezo aerosol apparatus 100 utilizing a tunnel formation in accordance with an exemplary embodiment of the present invention. The piezo aerosol apparatus 100 generally comprises a piezo component 105 and a metal plate 110, also referred to as a diaphragm. In an exemplary embodiment of the present invention, the piezo component 105 is shaped as a disc having a small circular section removed from its center region 120 to form a cylindrical hole (or opening) 125 in the center of the piezo component 105 (e.g., the piezo component 105 may have a doughnut or ring shape). The piezo component 105 may have a top surface 122 and a bottom surface 124. The piezo component 105 may comprise a ceramic having piezoelectric properties.

One skilled in the art will recognize that ceramic piezoelectric properties do not come from its chemical composition, but must include the proper formulation and be subjected to a high electric field for a short period of time to force the randomly oriented micro-dipoles into alignment (sometimes referred to as "poling"). Later, if a low-level electric field is applied in the opposite direction, the micro-dipoles undergo a dislodging stress, but the polarization of the ceramic bounces back upon removal of the electric field. This dislodging stress and bounce back of polarization causes the ceramic to vibrate, because of the transformation of mechanical strain to internal electric field shifts and vice versa.

The metal plate 110 may be shaped as a disc having a center region 130 and a cavity 135 with openings in the center region 130. The metal plate 110 may also have a top surface 132 and a bottom surface 134. The metal plate 110 may have a larger diameter than the piezo component 105. The metal plate 110 may comprise gold, silver, copper, zinc, aluminum, steel, or any other conducting metal or, combinations thereof. In a preferred embodiment of the present invention, the metal plate 110 comprises stainless steel.

The piezo component 105 may be affixed onto the metal plate 110 so that the bottom surface of the piezo component 105 is adjacent to the top surface of the metal plate 110. Additionally, the center 120 of the piezo component 105 is typically aligned with the center 130 of the metal plate 110 so that the cylindrical hole 125 of the piezo component 105 is situated proximate the center 130 of the metal plate 110. In a preferred embodiment of the present invention, there exists an adhesive layer 115 between the bottom surface 124 of the piezo component 105 and the top surface 132 of the metal plate 110. One skilled in the art will recognize that the adhesive layer 115 may include any appropriate bonding medium such as, but not limited to, glue, epoxy, or synthetic acrylic resins. The piezo component 105 and metal plate 110 of the piezo aerosol apparatus 100 may form a non-symmetrical compound that will produce vibration when a voltage, AC or DC or pulsating DC generated for example by an electronic timing circuit, is applied to the piezo component 105 and the metal plate 110.

Figure 2:
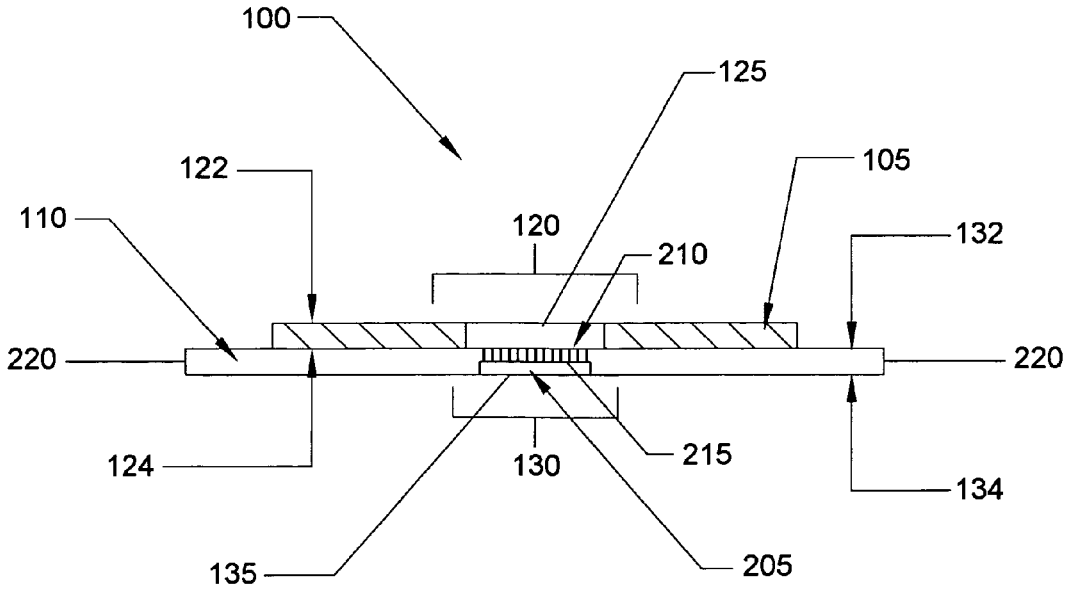
FIG. 2 is an aspect of an embodiment of the present invention comprising a piezo component having a tunnel formation.

FIG. 2 displays a diagram representation of the construction of a piezo aerosol apparatus 100 utilizing a tunnel formation in accordance with an exemplary embodiment of the present invention. The metal plate 110 may comprise a mist reservoir 205 and tapered holes 210 through which small amounts of a liquid may be transported from the mist reservoir 205 to the top 132 of the metal plate 110 and beyond. The mist reservoir 205 may be generally located in the center region 130 of the bottom surface 134 of the metal plate 110. In an exemplary embodiment of the present invention, the mist reservoir 205 may have approximately the same diameter as the cylindrical hole 125 of the piezo component 105. Accordingly, the mist reservoir 205 may also be of a cylindrical shape and may be positioned directly under the cylindrical hole 125 of the piezo component 105.

The mist reservoir 205 may be a cavity or engraving in the bottom surface 134 of the metal plate 110. The mist reservoir 205 forms an enclosure that is bounded on the top by the top surface 132 of the metal plate 110 having tapered holes 210 therein, and is open on the bottom for contact with the wick. In other words, the top surface 132 of the metal plate 110 remains intact, except for the tapered holes 210, forming the roof 215 of the mist reservoir 205. The roof 215 of the mist reservoir 205 may be located at the center portion of the top surface 132 of the metal plate 110 includes tapered holes 210. The tapered holes 210 may be made, for example, by laser drilling or etching the top surface 132 of the metal plate 110. The tapered holes 210 may be oriented substantially perpendicular to the roof 215 of the mist reservoir 205 and provide a path for liquid to travel from the mist reservoir 205. The mist reservoir 205 allows liquid to be sprayed or vaporized through the tapered holes 210 when the piezo aerosol apparatus 100 is actuated.

The construction of the piezo aerosol apparatus 100, as described above, results in the resonance of an ultrasonic frequency having an effective and power amplitude and output at the central region 120 of the piezo aerosol apparatus 100, when actuated with a radial mode of vibration. The effectiveness of the piezo aerosol apparatus 100 is realized by two non-parallel waves of displacement occurring at the same time. First, the greatest amount of displacement occurs at the central region 120 of the piezo aerosol apparatus 100, which is caused by a powerful ultrasonic frequency generated by a vertical mode of vibration. The ultrasonic frequency amplitude and output is greatest at the central region 120. Accordingly, orienting the cylindrical hole 125 of the piezo component 105, the mist reservoir 205, and the tapered holes 210 at the center 120 of the piezo aerosol apparatus 100 takes advantage of the displacement. Second, the regions of the piezo aerosol apparatus 100 extending outwardly from its center experience displacement that gradually decreases in amplitude and output. Accordingly, the displacement near the center 120 of the piezo aerosol apparatus 100 has a higher ultrasonic frequency, with higher amplitude and output, than the displacement near the outer edge 220 of the piezo aerosol apparatus 100. Additionally, if the outer edge 220 or the boundary area of the piezo aerosol apparatus 100 is fixed or restrained, then the displacement at the outer edge 220 is approximately equal to zero. Although the axial resonance of the outer edge 220 is weak, the displacement at the outer edge 220 effectively supports the actuated piezo aerosol apparatus 100, provided that the displacement does not remain at zero, for example, the outer edge is not fixed or restrained.

As described above, the displacement at the outer edge 220 effectively supports the actuated piezo aerosol apparatus 100, so long as the outer edge 220 is not fixed. A restrained or fixed outer edge 220 would interfere with the effectiveness of the actuated piezo aerosol apparatus 100. Consequently, the holder or holding of the piezo aerosol apparatus should not restrain or fix the outer edge 220 of the piezo aerosol apparatus 100. Instead, the outer edge 220 of the piezo aerosol apparatus 100 should be as free to move as possible during actuation.

Figure 3:
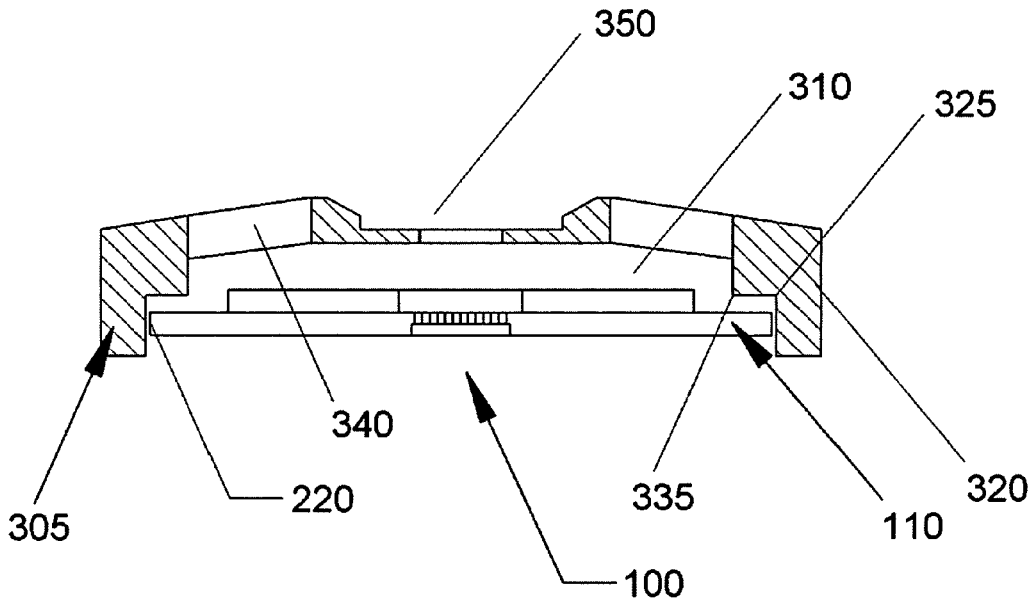
FIG. 3 is a diagram of an embodiment of a floating washer in combination with a piezo component of the present invention.

FIG. 3 displays a diagram representation of a floating washer 305 applied to a piezo aerosol apparatus 100 utilizing a tunnel formation in accordance with an exemplary embodiment of the present invention. To keep the outer edge 220 of the piezo aerosol apparatus 100 as free as possible during actuation, a floating washer 305 may be utilized with the piezo aerosol apparatus 100. The floating washer 305 may be generally shaped as a dome. The floating washer 305 may be placed over the top of the piezo aerosol apparatus 100 without interfering with the functionality of the piezo aerosol apparatus 100. The floating washer 305 provides a chamber 310 for the piezo aerosol apparatus 100 to reside. The outer edge 315 of the floating washer 305 may form a vertical wall 320, where the inner side 325 of the vertical wall is proximate to or adjacent with the outer edge 220 of the piezo aerosol apparatus 100. In an exemplary embodiment of the present invention, the inner side 325 of the vertical wall 320 is close enough to adequately orient the piezo aerosol apparatus 100, but does not fix or restrain the outer edge 220 of the piezo aerosol apparatus 100. Additionally, the inner side 325 of the vertical wall 320 of the floating washer 305 is situated proximate to the outer edge 220 of the piezo aerosol apparatus 100 so that the floating washer 305 does not disturb resonance during actuation of the piezo aerosol apparatus 100.

The vertical wall 320 of the floating washer 305 includes a corner 335 where the inner wall 325 and the bottom 340 of the floating washer 305 (e.g., the dome ceiling) meet. This corner 335, as well as the height of the vertical wall 320, effectively restricts the upward movement of the piezo aerosol apparatus 100 during actuation. The center portion 350 of the floating washer 305 has tapered holes therethrough so that the liquid from the mist reservoir of piezo aerosol apparatus may be transmitted through the floating washer. The center portion 350 is aligned with the center portion of the piezo aerosol apparatus. For example, the cap may have one opening on its central axis through which the atomized fluid is ejected. In action then, the liquid is wicked into the mist reservoir and is transmitted through the openings in the mist reservoir roof, through the hole in the floating washer, through the center of the spring and the opening in the cap.

One skilled in the art will recognize that the floating washer 305 may be constructed of any appropriate material, which may be selected to maximize the support of the piezo aerosol apparatus 100 while allowing the piezo aerosol apparatus 100 the freedom to effectively vibrate. Suitable materials include plastics or low density metal plate, including but not limited to polyacetals such as Derlin, polyoxymethlylene (POM), polypropylene, PP, Nylon and other polyamides, (PA) and aluminum. Suitable materials may be any light weight material that provides the functionality of the floating washer and are not effected by the liquid dispensed from the mist reservoir, such as organic solvents.

Figure 4:
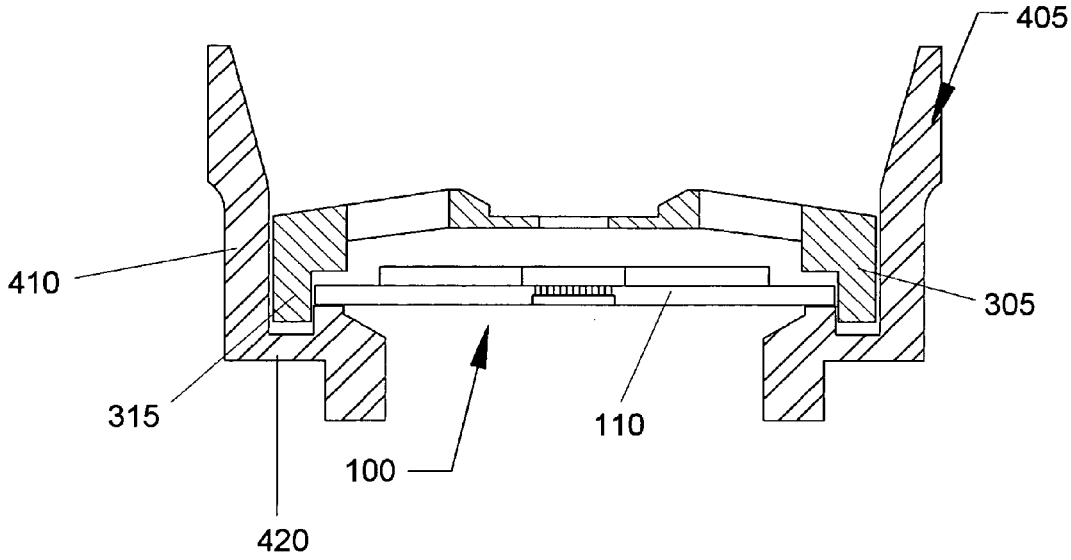
FIG. 4 is a diagram of an embodiment of a floating washer holder in combination with a piezo component of the present invention.

FIG. 4 displays a diagram representation of a floating washer holder 405 applied to a piezo aerosol apparatus 100 utilizing a tunnel formation in accordance with an exemplary embodiment of the present invention. To ensure that the floating washer 305 remains properly in place around the piezo aerosol apparatus 100, the present invention may include a floating washer holder 405. The floating washer holder 405 may include a vertical wall 410, where the inner side 415 of the vertical wall 410 is proximate the outer wall 315 (e.g., outer edge) of the floating washer 305. The bottom of the vertical wall 410 meets perpendicularly with the floor 420 of the floating washer holder 405, so that a cross-sectional view of the floating washer holder 405 generally resembles the shape of the letter "L." The floor 420 of the floating washer holder 405 is long enough to adequately support the floating washer 305 and the piezo aerosol apparatus 100, but does not interfere with the mist reservoir 205 of the metal plate 110. The floating washer holder 405, therefore, allows a wick (not shown) to freely contact the piezo aerosol apparatus 100 (e.g., near the mist reservoir 205). Accordingly, the floating washer holder 405 enables a wick to contact the mist reservoir of piezo aerosol apparatus 100. Such a floating washer holder 405 assists in enhancing the freedom of the piezo aerosol apparatus to vibrate freely during resonance.

Figure 5:
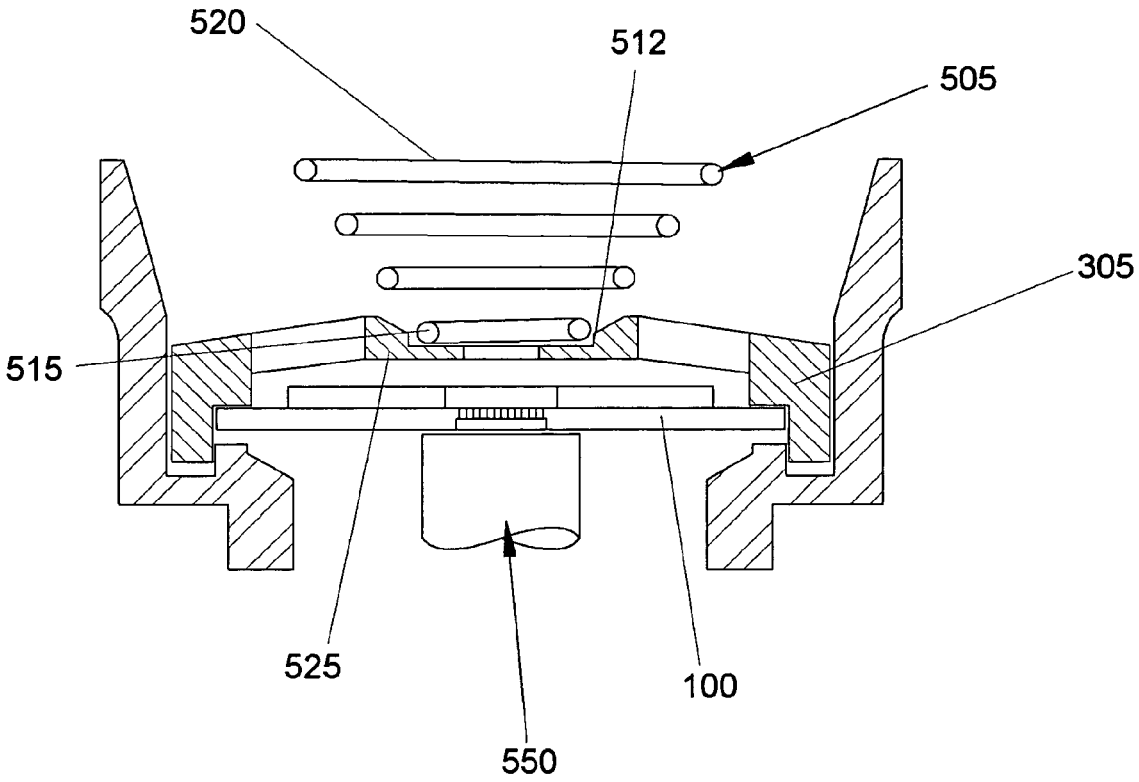
FIG. 5 is a diagram of an embodiment of a conical spring system in combination with a piezo component of the present invention.

FIG. 5 displays a diagram representation of a conical spring system 505 applied to a piezo aerosol apparatus 100 utilizing a tunnel formation with a floating washer in accordance with an exemplary embodiment of the present invention. The present invention may include a conical spring system 505 to assist the piezo aerosol apparatus 100 to properly engage substantially all of a wick 550 top surface with the lower opening of the mist reservoir 205, no matter how the wick 550 moves or shifts to different angles. Generally, the conical spring system 505 may comprise a flexible material, such as very soft and thin brass. The conical spring system 505 is typically tapered with a varying diameter across its length. A small diameter end 515 of the conical spring system 505 is oriented adjacent to the outside roof 512 of the floating washer 305, and a large diameter end 520 of the conical spring system 505 is orientated away from the floating washer 305. To adequately support the small diameter end 515 of the conical spring system 505, there may exist a depression 525 (or indentation) on the center of the roof or, the dome 512 of the floating washer 305. The depression 525 provides a place for the small diameter end 515 of the conical spring system 505 to reside. The conical spring system 505 provides a smooth transition of tension and force from the large end 520 of the conical spring system 505 to the small diameter end 515 of the conical spring system 505. The conical spring system 505, therefore, provides the ability of the floating washer 305 and piezo aerosol apparatus 100 to accommodate any movement of the wick 550.

Figure 6:
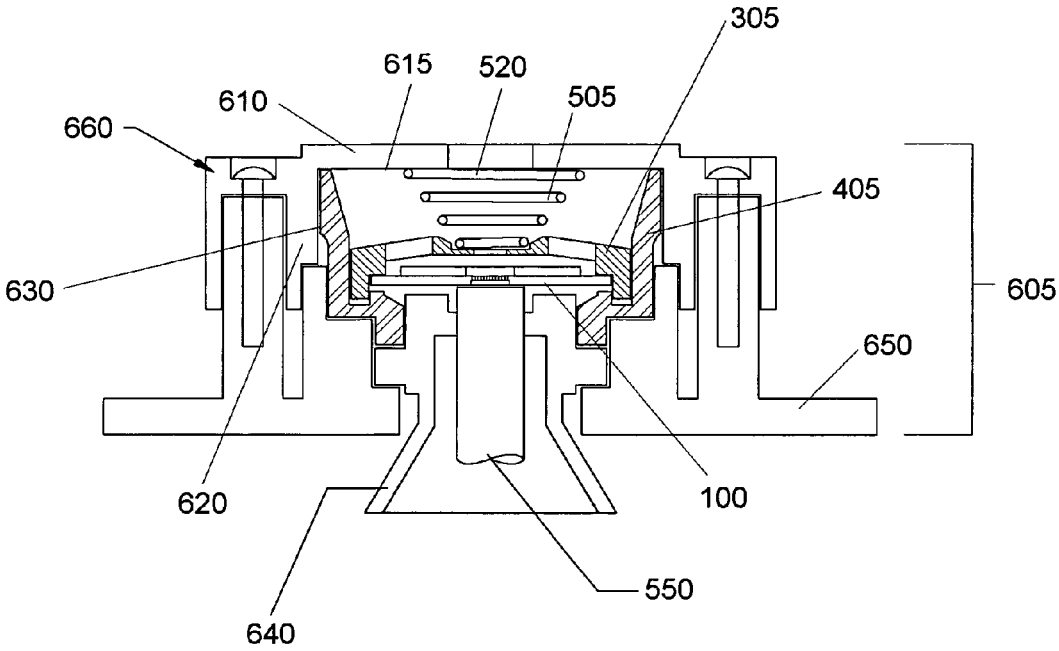
FIG. 6 is a diagram of an embodiment of a holding system chamber in combination with a piezo component of the present invention.

FIG. 6 displays a diagram representation of a holding system chamber 605 applied to a piezo aerosol apparatus 100 utilizing a tunnel formation with a conical spring system 505 in accordance with an exemplary embodiment of the present invention. The holding system chamber 605 generally comprises a base 650 and a cap 660. As shown in FIG. 6, the wick 550 extends from a container 640 to the lower opening of the mist reservoir 205. To provide the conical spring system 505 with the necessary tension, the present invention may include a holding system chamber 605 placed over the piezo aerosol apparatus 100, floating washer 305, floating washer holder 405, and conical spring system 505

The holding system chamber 605 has a flat ceiling 610, where the inner side 615 of the flat ceiling 610 encounters the large end 520 of the conical spring system 505. The holding system chamber 605 may also include vertical walls 620 at the outer edge 625 of the holding system chamber 605, where the inner sides 630 of the vertical walls 620 are adjacent to the floating washer holder 405. The holding system chamber 605 may comprise any suitable material, such as, but not limited to, plastic, PP, PA and POM. The holding system chamber 605 acts as the cap 660 for the piezo aerosol apparatus 100, floating washer 305, floating washer holder 405 and conical spring system 505, where the holding chamber system 605 does not interfere with the performance of the piezo aerosol apparatus 100. As shown, the large diameter end 520 of the conical spring system 505 engages the cap 660 on the inner side 615, the small diameter end 515 engages the floating washer 305 enabling the floating washer 305 to float above the piezo aerosol apparatus 100, and the cap 660 is mounted to the base 650.

In operation, the exemplary embodiment of the present invention as described above with reference to FIGS. 1-6 may be applied to most devices utilizing a wick system. As designed, the wick 550 remains freely in contact with the mist reservoir 205 of the piezo aerosol apparatus 100, where the mist reservoir 205 is proximate the top surface of the wick 550. As liquid is drawn to the top of the wick 550 from the container 640, the liquid finds an outlet in the mist reservoir 205. When an electric current is applied to the piezo aerosol apparatus 100, the ultrasonic frequency is strongest at the center 120 near the mist reservoir 205. The vibration rapidly draws the liquid in the mist reservoir 205 towards the tapered holes 210 of the metal plate 110. By the resonance of the metal plate caused by the piezo component 105, the high-speed particles of liquid forms an aerosol when leaving the tapered holes 210, and the aligned holes of the floating washer and cap.

Figures 7A, 7B, 7C:
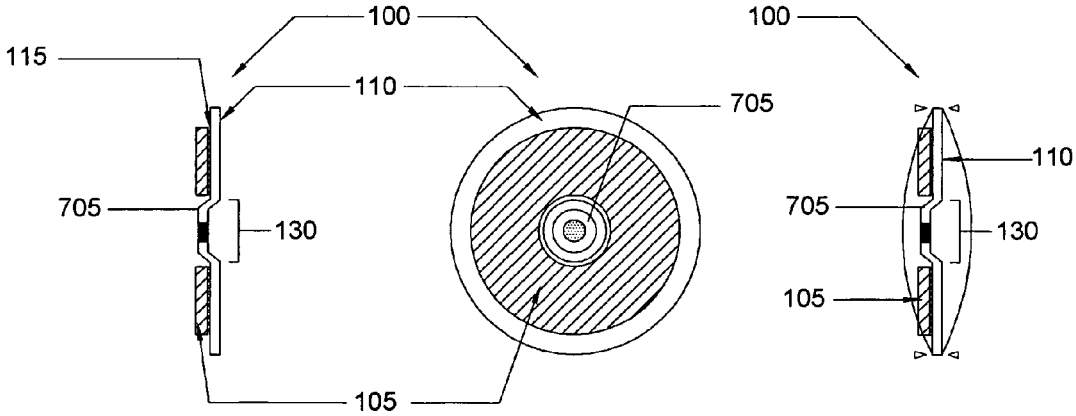
FIGS. 7A-C are diagrams of an embodiment of the present invention comprising a plateau formation.
Figure 8:
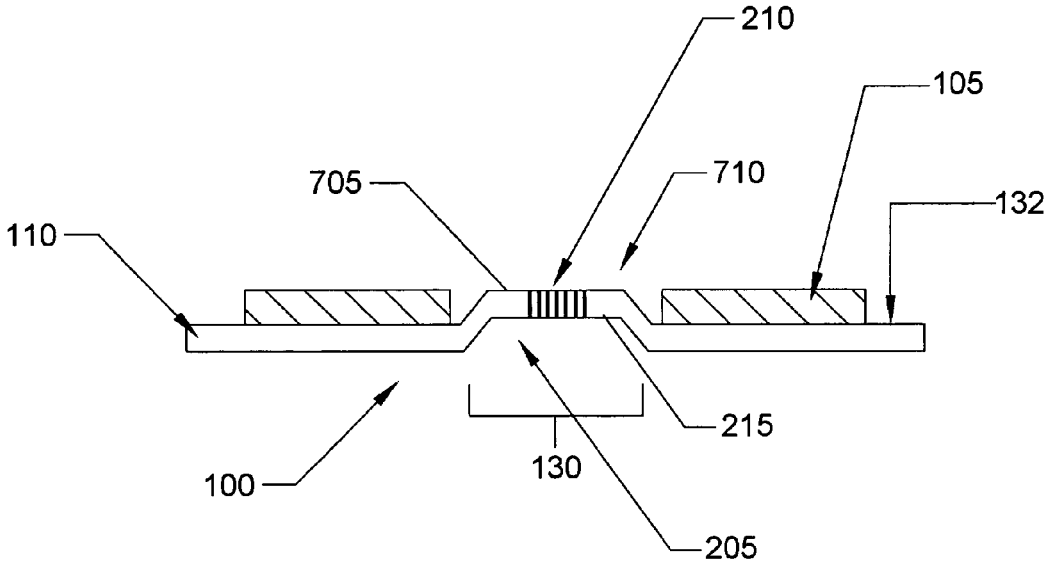
FIG. 8 is an aspect of an embodiment of the present invention comprising a piezo component having a plateau formation.
Figure 9:
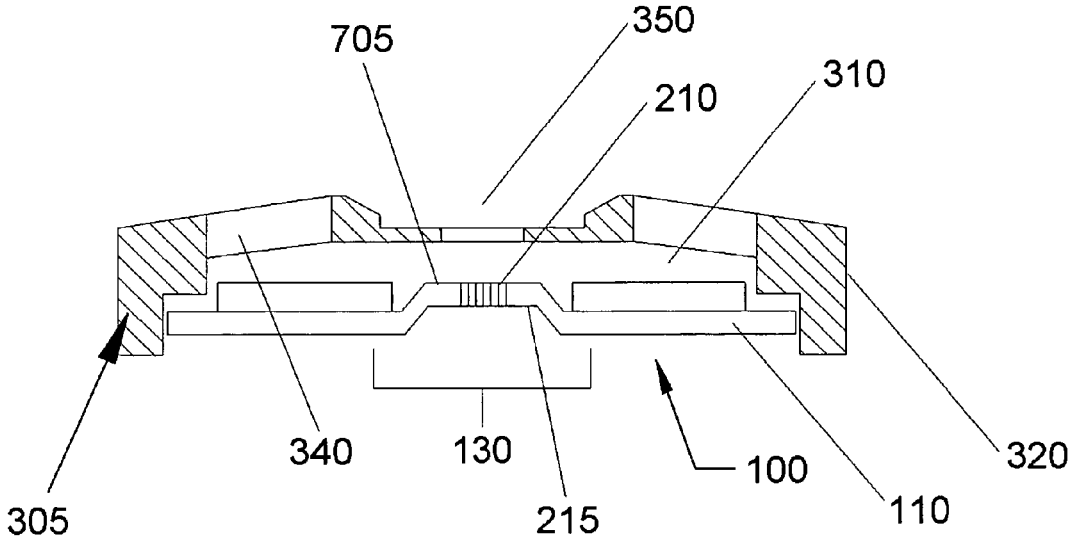
FIG. 9 is a diagram of an embodiment of a floating washer in combination with a piezo component of the present invention.
Figure 10:
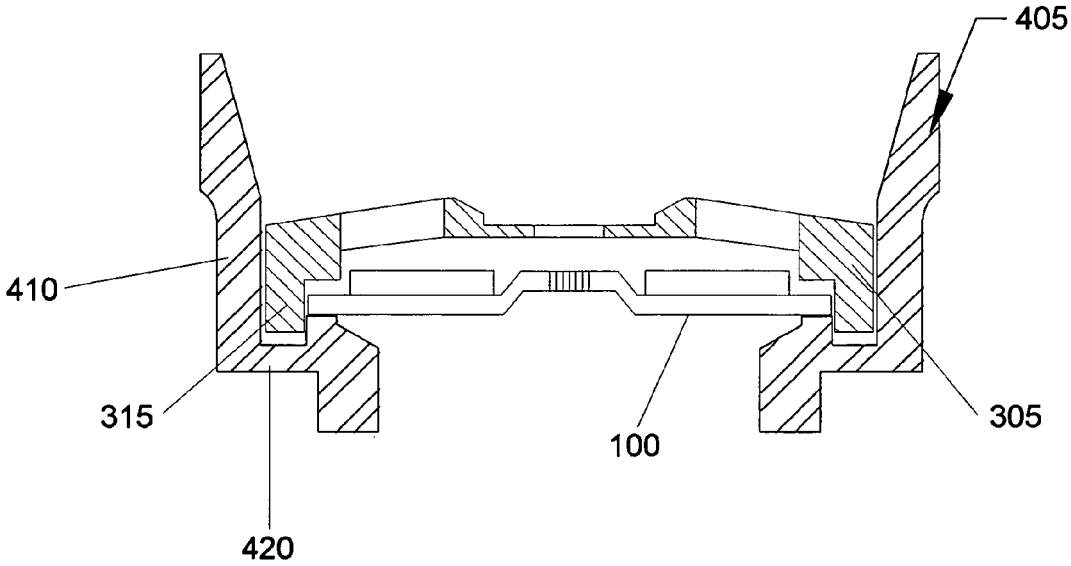
FIG. 10 is a diagram of an embodiment of a floating washer holder in combination with a piezo component of the present invention.
Figure 11:
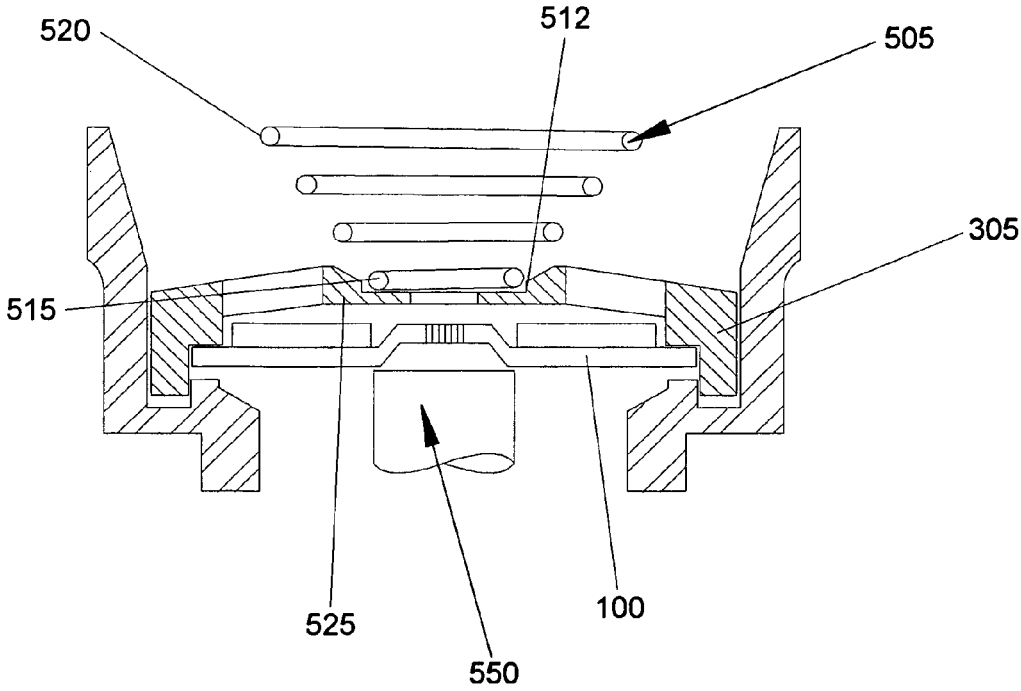
FIG. 11 is a diagram of an embodiment of a conical spring system in combination with a piezo component of the present invention.
Figure 12:
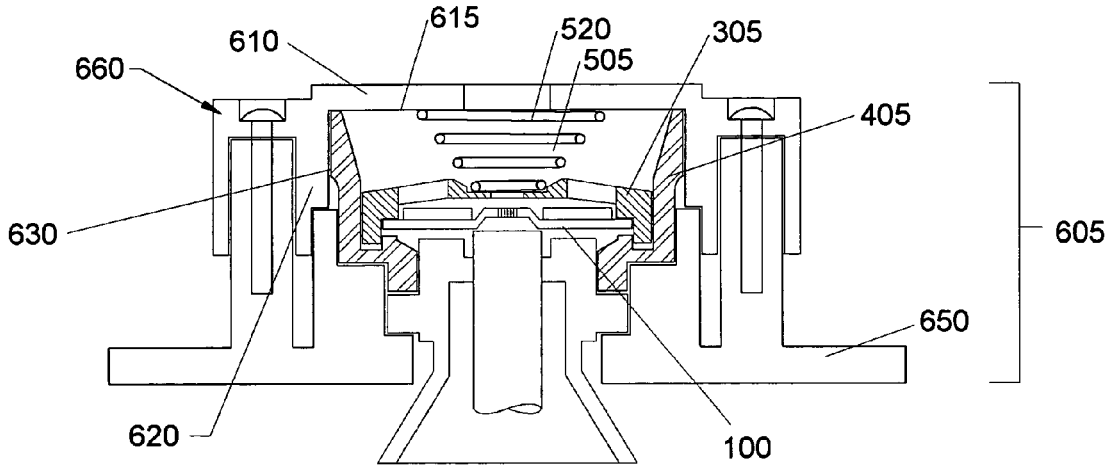
FIG. 12 is a diagram of an embodiment of a holding system chamber in combination with a piezo component of the present invention

FIGS. 7A-C are diagrams of the displacement of a piezo aerosol apparatus 100 utilizing a plateau formation in accordance with an exemplary embodiment of the present invention. In another exemplary embodiment of the present invention, the piezo aerosol apparatus 100 comprises a piezoelectric ceramic 105, a metal plate 110, and an adhesive layer 115, similar to those described above with reference to FIGS. 1A-C. This embodiment is a non-symmetrical piezo component in which a ring-shaped piezo ceramic 105 is adhered or attached to the metal plate 110, preferably a stainless steel plate. In this embodiment, the metal plate 110 is formed to comprise a raised plateau 705 in the center region 130 of the metal plate 110. As discussed for the other embodiments, the amplitude and frequency are highest in the central region. When actuated, the piezo component 105 generates a radial mode vibration during resonance FIG. 8 displays a diagram representation of the construction of a piezo aerosol apparatus 100 utilizing a plateau formation in accordance with an exemplary embodiment of the present invention. The raised plateau 705 may be formed by pressing a single thin metal plate, such as, but not limited to, a stainless steel plate, using processes known to those skilled in the art, such as a coining process. The raised plateau 705 may be formed in the center region 130 of the metal plate 110, to create a mist reservoir 205 underneath the raised plateau 705. The metal plate 110, as shown in FIG. 8, may have the same thickness throughout, whereas an embodiment with the tunnel form of mist reservoir 205 may have a thinner center as does the metal plate 110 described in FIGS. 1-6. The raised plateau 705 is generally located at the center region 130 of the top surface 132 and is raised above the top surface 132 of the metal plate 110. In an exemplary embodiment of the present invention, the raised plateau 705 may have any diameter less than the diameter of the raised plateau within the cylindrical hole 125 of the piezo component 105. Accordingly, the raised plateau 705 may also be of a cylindrical shape and may be positioned directly under the cylindrical hole 125 of the piezo component 105.

The top surface 710 of the raised plateau 705 forms the roof 215 of the mist reservoir 205 located directly underneath. The roof 215 of the mist reservoir 205 (e.g., the top surface 710 of the raised plateau 705) includes tapered holes 210 that may be made, for example, by a laser drill or by etching the top surface 710 of the metal plate 110. The tapered holes 210 may be substantially oriented perpendicular to the roof 215 of the mist reservoir 205 and provide a path for liquid to travel from the mist reservoir 205.

Other than the raised plateau 705 in the metal plate 110, as described above, the construction and design of the piezo aerosol apparatus 100 (including the floating washer 305, floating washer holder 405, conical spring system 505, and holding system chamber 605) utilizing plateau formation is substantially similar to the construction and design of the piezo aerosol apparatus 100 utilizing tunnel formation. Accordingly, the detailed descriptions above for FIGS. 2-6 adequately disclose and describe FIGS. 9-12, respectively, and are incorporated herein by reference.

Figure 13:
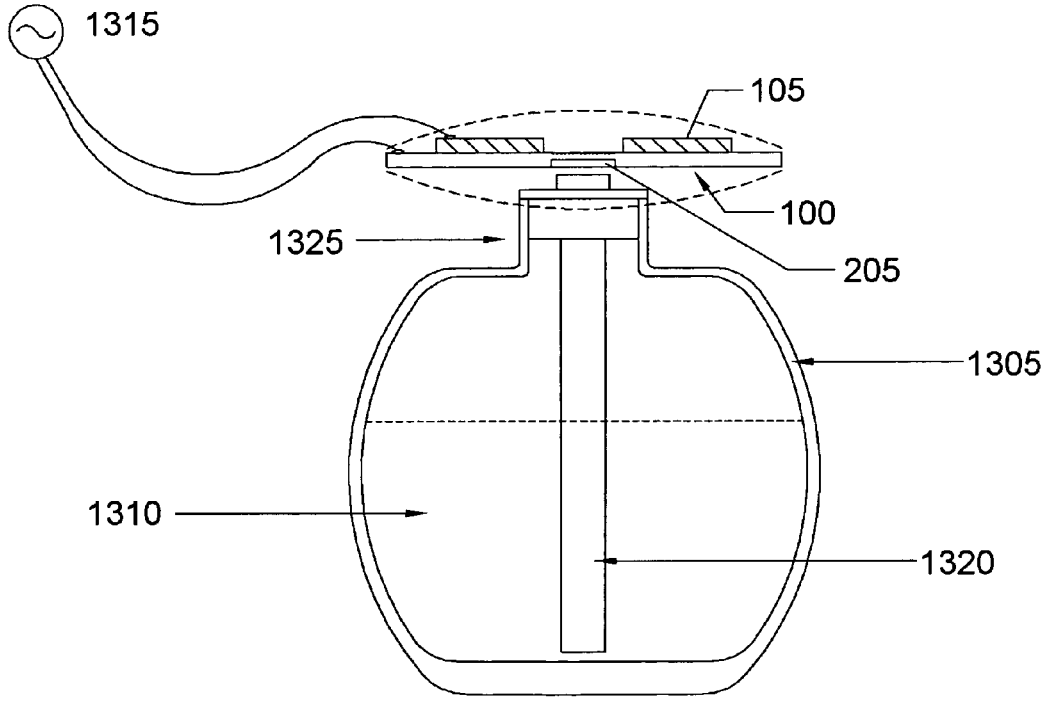
FIG. 13 is a diagram of an embodiment of a piezo apparatus functionally connected to a container of fluid.

FIG. 13 displays a diagram representation of a piezo aerosol apparatus 100 functionally connected to a container 1305 of fluid 1310 in accordance with an exemplary embodiment of the present invention. In operation, the piezo aerosol apparatus 100 (utilizing either tunnel or plateau formation) may be physically connected to a container 1305 (e.g., a bottle 1305), where a wick 1320 extends upwardly out of an opening 1325 of the container 1305 to become proximate to the mist reservoir 205 of the piezo aerosol apparatus 100. The wick 1320 may extend downwardly into the container 1305 and liquid 1310 therein. One skilled in the art will recognize that the liquid 1310 within the container 1305 may include, but is not limited to, water, oil, lubrication, paint, perfume, cologne, or any other appropriate liquid 1310 to be transformed into an aerosol. As the wick 1320 draws the liquid 1310 up to the mist reservoir 205 through capillary action, the vibration of the piezo component 105 transports the liquid through the tapered holes 210 of the mist reservoir 205 creating an aerosol of the liquid. To actuate the piezo component 105, a power supply 1315 may be present and connected to the piezo aerosol apparatus 100. The power supply 1315 may provide a voltage necessary to actuate the piezo component 105 at an ultrasonic frequency, thus causing the resonance necessary to vibrate the piezo component 105.

Figure 14:
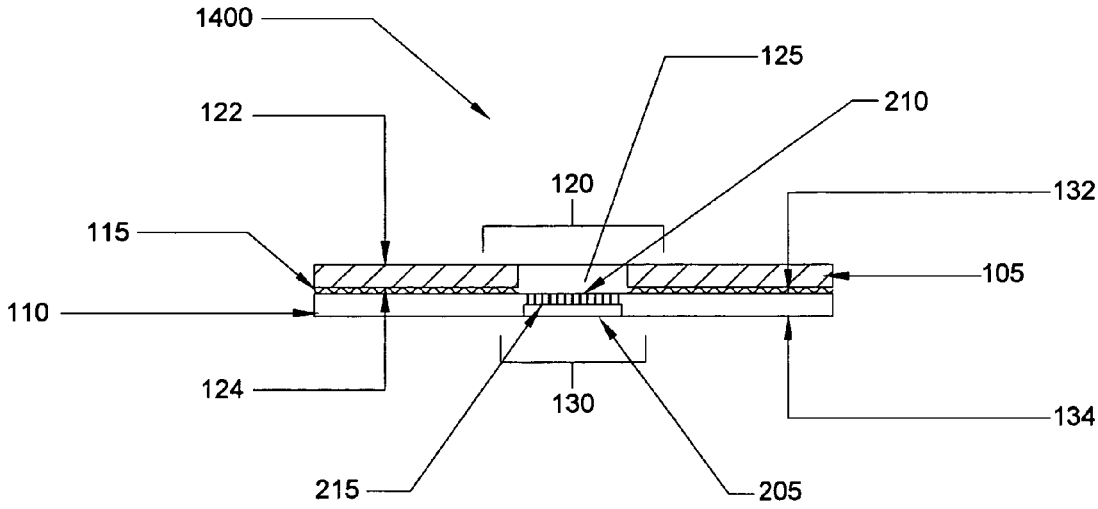
FIG. 14 is a diagram of an ultrasonic atomizer utilizing a tunnel formation in accordance with an exemplary embodiment of the present invention.

FIG. 14 displays a diagram representation of the construction of an fluid atomizer 1400 utilizing a tunnel formation wherein the embodiment comprises a nonsymmetrical piezo ceramic and metal combination wherein the piezo component 105 and a metal plate 110 are similar to those described above with reference to the piezo aerosol apparatus 100, except that the diameters of the piezo component 105 and the metal plate 110 may be substantially equal.

The piezo component 105 may be affixed onto the metal plate 110 so that the bottom surface 124 of the piezo component 105 is adjacent to the top surface 132 of the metal plate 110. The piezo component 105 and the metal plate 110 have substantially the same diameter, the center region 120 of the piezo component 105 is aligned with the center region 130 of the metal plate 110 so that the cylindrical hole 125 of the piezo component 105 is situated at the center of the metal plate 110 and above the mist reservoir 205. Additionally, there may exist an adhesive layer 115 between the bottom 124 of the piezo component 105 and the top surface 132 of the metal plate 110.

Similar to the piezo aerosol apparatus 100 utilizing tunnel formation described above, the metal plate 110 may comprise a mist reservoir 205 and tapered holes 210 where small amounts of a liquid may be transported from the mist reservoir 205 through the tapered holes. The mist reservoir 205 may be generally located at the center region 130 of the bottom surface 134 of the metal plate 110. In an exemplary embodiment of the present invention, the mist reservoir 205 may be the same diameter or a smaller diameter as that of the cylindrical hole 125 of the piezo component 105. Accordingly, the mist reservoir 205 may also have a cylindrical shape and may be positioned directly under the cylindrical hole 125 of the piezo component 105. The mist reservoir 205 may be a cavity or engraving in the bottom of the metal plate 110. The top surface 132 of the metal plate 110 forms the roof 215 of the mist reservoir 205. The roof 215 of the mist reservoir 205 (e.g., the center portion 130 of the top of the metal plate 110) includes tapered holes 210 that may be made, for example, by laser drilling or by etching the top surface 132 of the metal plate 110. The tapered holes 210 may be oriented substantially perpendicular to the roof 215 of the mist reservoir 205 and provide a path for liquid to travel from the mist reservoir 205. The mist reservoir 205 provides for liquid to be sprayed or vaporized through the tapered holes 210 on the top of the metal plate 110 when the ultrasonic atomizer 1400 is actuated.

Figure 15:
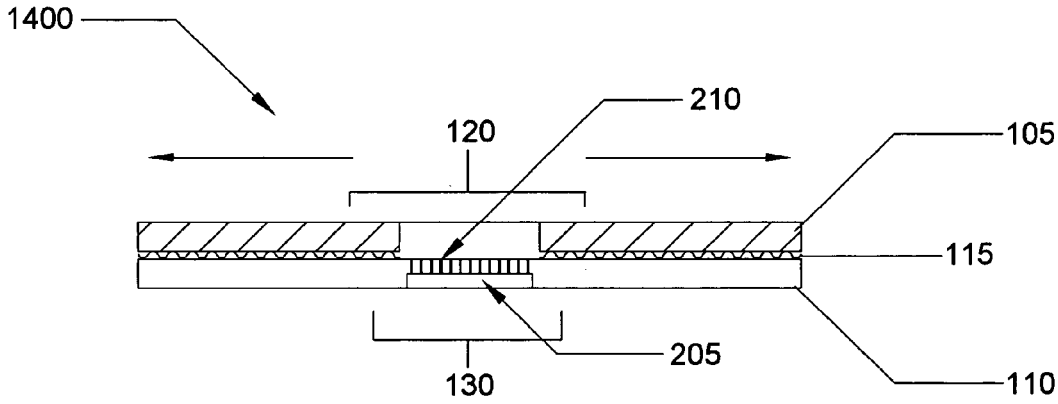
FIG. 15 is a diagram of the displacement of an ultrasonic atomizer utilizing a tunnel formation in accordance with an exemplary embodiment of the present invention.

FIG. 15 displays a diagram representation of the displacement of an ultrasonic atomizer 1400 utilizing a tunnel formation in accordance with an exemplary embodiment of the present invention. The unique construction of the ultrasonic atomizer 1400, as described above, results in the resonance of an ultrasonic frequency having an effective amplitude and output at the central region 120 of the ultrasonic atomizer 1400, when actuated with a radial mode of vibration. When an electric current (or voltage) is applied to the ultrasonic atomizer 1400, the mist reservoir 205 (e.g., the center 130 of the metal plate 110) receives a significant displacement of output and intensity. In an exemplary embodiment of the present invention, a wick (not shown) remains freely in contact with the mist reservoir 205 of the ultrasonic atomizer 1400, where the mist reservoir 205 is proximate to the top surface of the wick. As liquid is drawn to the top of the wick the liquid finds an outlet in the mist reservoir 205. During actuation of the ultrasonic atomizer 1400, the vibration rapidly draws the liquid in the mist reservoir 205 towards the tapered holes 210 of the metal plate 110. By the resonance of the metal plate 110 caused by the piezo component 105, the high-speed particles of liquid leave the tapered holes 210.

Figure 16A:
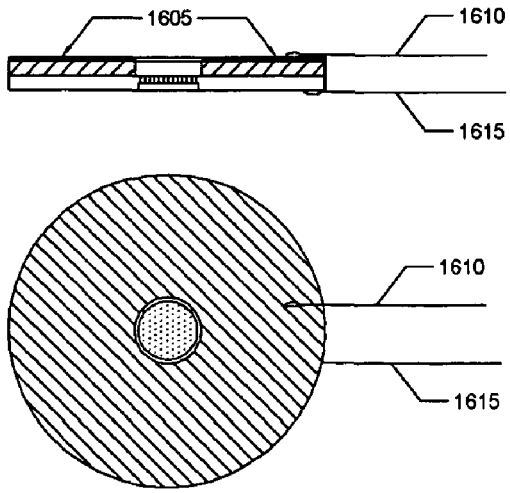
FIGS. 16A-C are diagrams of multiple soldering types of ultrasonic atomizers utilizing a tunnel formation in accordance with an exemplary embodiment of the present invention.
Figure 16B:
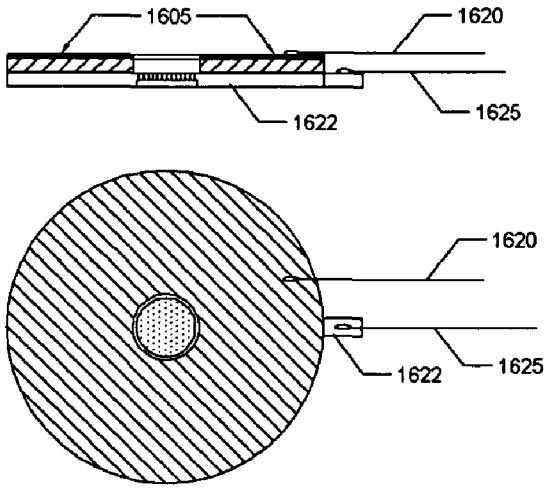
Figure 16C:
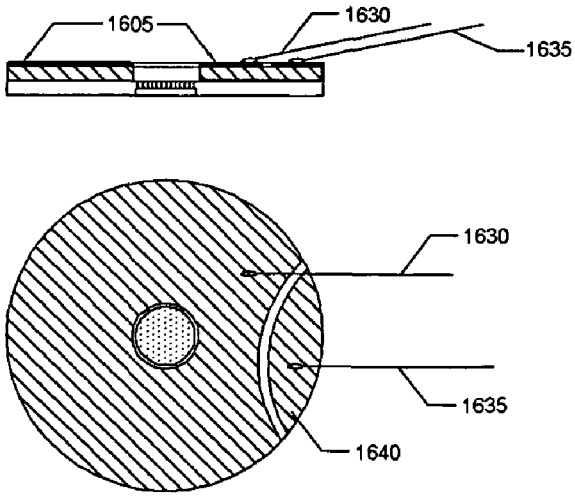

FIGS. 16A-C display a diagram representation of multiple soldering types of ultrasonic atomizers 1400 utilizing a tunnel formation in accordance with an exemplary embodiment of the present invention. An electrode 1605 may be applied to the top surface 122 of the piezo component 105 to assist in providing an electric current (or voltage) to the ultrasonic atomizer 1400 for actuation. One skilled in the art will recognize that an electrode 1605 is generally a solid electric conductor though which an electric current may flow. Lead lines from a power source (not shown) may be connected in the ultrasonic atomizer in several unique configurations. First, a lead line 1610 may be connected to an electrode 1605 formed on the piezo component 105, and another lead line 1615 may be connected to the bottom of the metal plate 110. Second, a lead line 1620 may be connected to an electrode 1605 formed on the piezo component 105, and another lead line 1625 may be connected to a post 1622 coupled to and extending from the metal plate 110. Third, a lead 1630 line may be connected to an electrode 1605 coupled to the piezo component 105, and another lead line 1635 may be connected to the top of a shielded electrode 1640, where the electrode 1605 and shielded electrode 1640 are separated. Each of these configurations allows an electric current to flow through the ultrasonic atomizer 1400, thus actuating the piezo component 105 and causing vibration.

Figure 17:
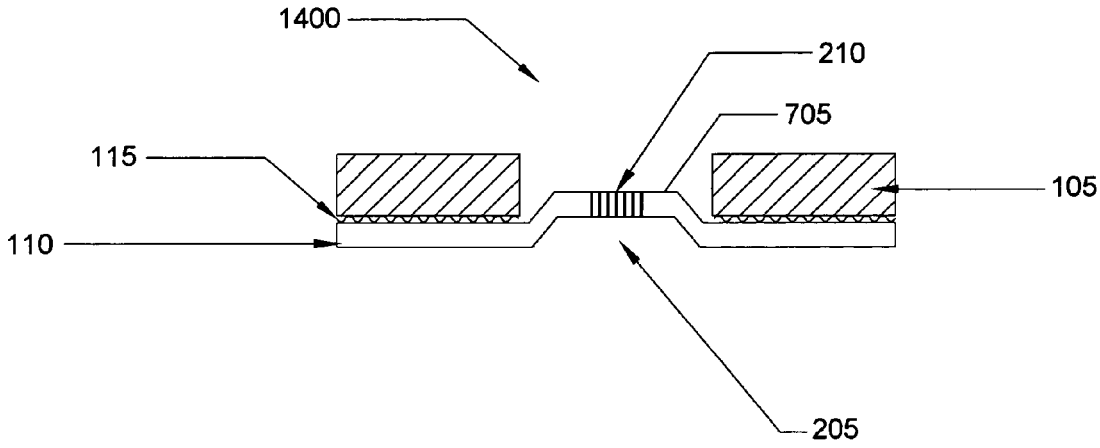
FIG. 17 is a diagram of an ultrasonic atomizer utilizing a plateau formation in accordance with an exemplary embodiment of the present invention.

FIG. 17 displays a diagram representation of the construction of a fluid atomizer 1400 utilizing a plateau formation in accordance with an exemplary embodiment of the present invention. In another exemplary embodiment of the present invention, the fluid atomizer 1400 comprises a piezo component 105, a metal plate 110, and an adhesive layer 115, similar to those described above with reference to FIG. 14. The diameter of the piezo component 105 and the metal plate 110 may be substantially equal. The metal plate 110, however, comprises a raised plateau 705 in the center region 130 of the metal plate 110. The ultrasonic frequency is higher in output and amplitude at the raised plateau 705 (e.g., the center 120 of the actuated ultrasonic atomizer 1400). When actuated, the piezo component 105 generates a radial mode vibration during resonance.

Like the piezo aerosol apparatus 100 utilizing plateau formation described above, the metal plate 110 may be formed by pressing a single thin metal plate using a coining process. The raised plateau 705 may be formed in the center region 130 of the metal plate 110, to create a mist reservoir 205 underneath the raised plateau 705. The metal plate 110 is formed (or bent) to have the raised plateau 705 and, forms the mist reservoir 205.

Other than the raised plateau 705 in the metal plate 110, as described above, the construction and design of the fluid atomizer 1400 utilizing plateau formation is substantially similar to the construction and design of the ultrasonic atomizer 1400 utilizing tunnel formation.

Figure 18:
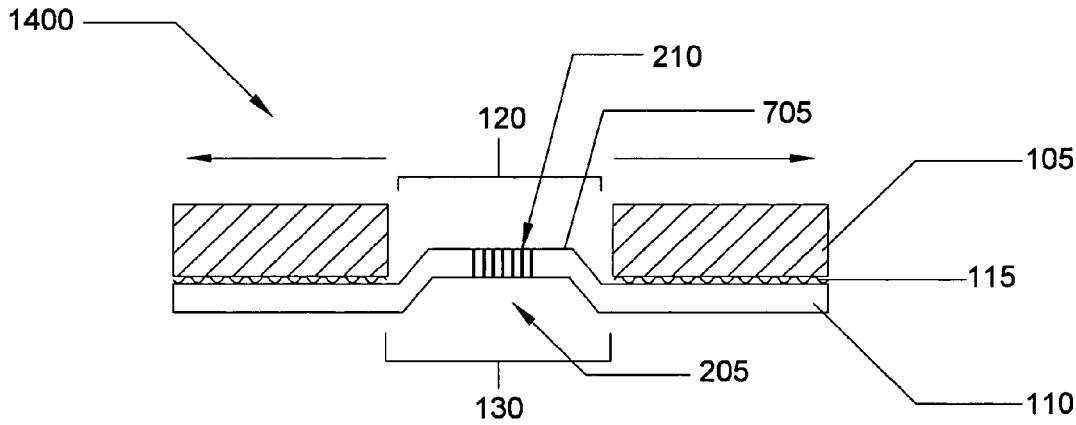
FIG. 18 is a diagram of the displacement of an ultrasonic atomizer utilizing a plateau formation in accordance with an exemplary embodiment of the present invention.

FIG. 18 displays a diagram representation of the displacement of a fluid atomizer 1400 utilizing a plateau formation in accordance with an exemplary embodiment of the present invention. The construction of the ultrasonic atomizer 1400, as described above, allows for the resonance of an ultrasonic frequency having its highest amplitude and output at the central region 120 of the ultrasonic atomizer 1400, when actuated with a radial mode of vibration. When an electric current (or voltage) is applied to the ultrasonic atomizer 1400, the mist reservoir 205 (e.g., the center 130 of the metal plate 110) receives a displacement of output and intensity. In an exemplary embodiment of the present invention, a wick (not shown) remains freely in contact with the mist reservoir 205 of the ultrasonic atomizer 1400, where the mist reservoir 205 is proximate to the top surface of a wick. As liquid is drawn to the top of the wick the liquid finds an outlet in the mist reservoir 205. During actuation of the ultrasonic atomizer 1400, the vibration rapidly draws the liquid in the mist reservoir 205 towards the tapered holes 210 of the metal plate 110. By the resonance of the metal plate with the piezo component 105, the particles of liquid leave through the tapered holes 210.

Figure 19A:
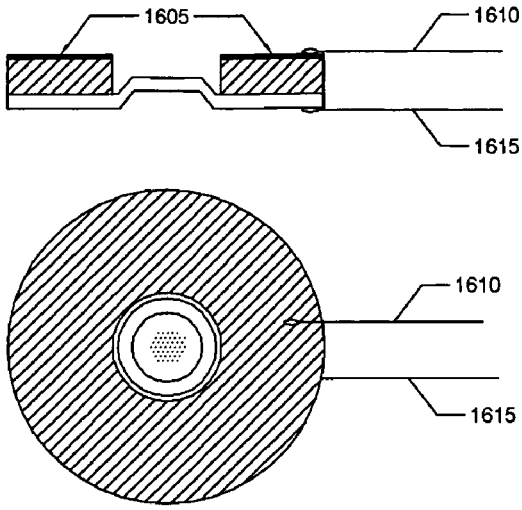
FIGS. 19A-C are diagrams of multiple soldering types of ultrasonic atomizers utilizing a plateau formation in accordance with an exemplary embodiment of the present invention.
Figure 19B:
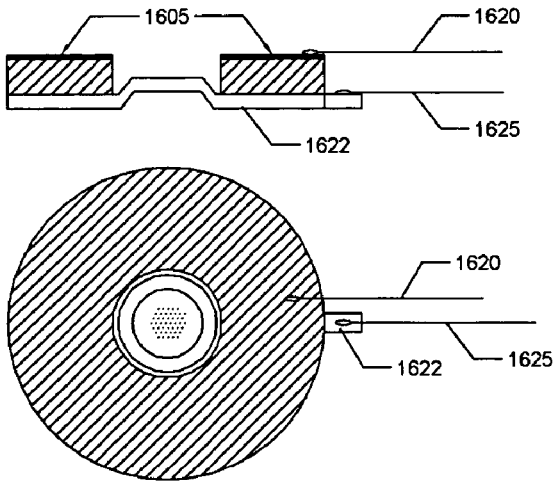
Figure 19C:
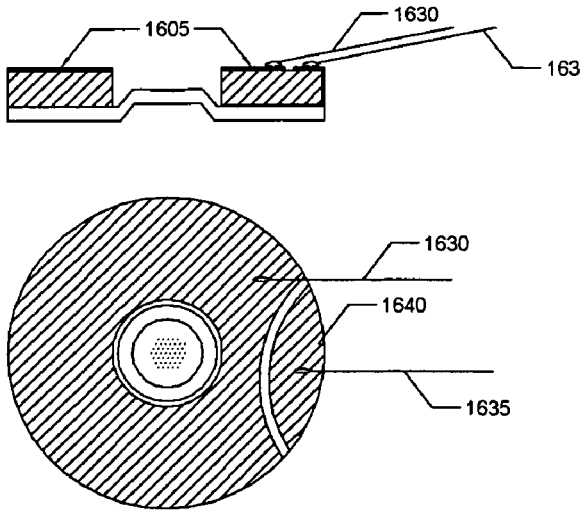
Figure 20A:
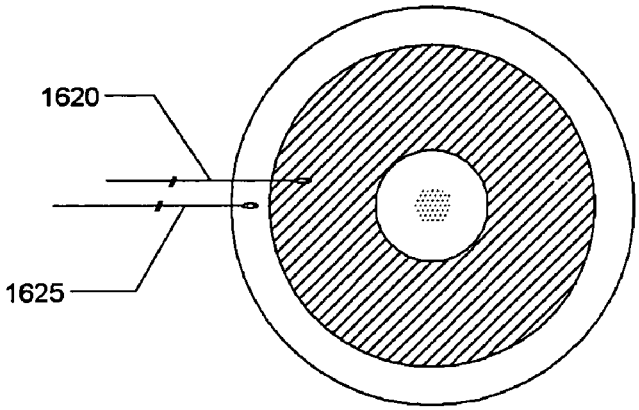
FIGS. 20A-D are diagrams of multiple soldering types.
Figure 20B:
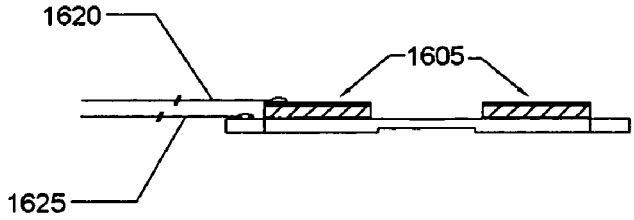
Figure 20C:
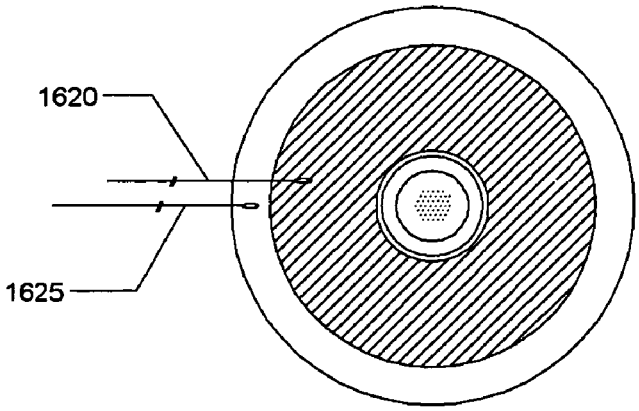
Figure 20D:
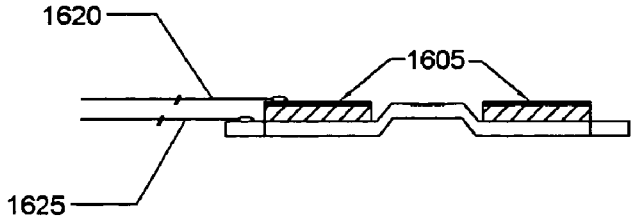

FIGS. 19A-C are diagrams of multiple soldering placements for fluid atomizers 1400 utilizing a plateau formation with a similar sized diameter ceramic disc and metal plate, in accordance with an exemplary embodiment of the present invention. Except for the use of a fluid atomizer 1400 utilizing a plateau formation (instead of a tunnel formation), the description for FIGS. 16A-C adequately describes FIGS. 19A-C and are incorporated herein by reference.

FIGS. 20A-D are diagrams of multiple soldering placements for fluid atomizers according to the present invention utilizing tunnel form and plateau form mist reservoirs wherein the ceramic disc has a smaller diameter than the metal plate. Except for the use of a fluid atomizer 1400 utilizing a plateau formation (instead of a tunnel formation), the description for FIGS. 16A-C adequately describes FIGS. 20A-D and are incorporated herein by r Methods of the present invention comprise providing aerosolized fluids using embodiments of one or more of the apparatus disclosed herein. Piezo devices such as the present ones may also be used in other applications including, but not limited to toys and healthcare devices. For example, in toys where special effects are wanted, such as smoke from a toy train engine, the "smoke" effect could be made by aerosols from the piezo device of the present invention, without the need for fire or smoke from burning or chemical reactions. Additionally, soluble drugs can be expelled from piezo devices of the present invention into humans or animals for, for example, respiratory, oral or nasal routes of administration.

Whereas the present invention has been described in detail above with respect to an embodiment thereof, it is understood that variations and modifications can be effected within the spirit and scope of the invention, as described herein before and as defined in the appended claims. The corresponding structures, materials, acts, and equivalents of all means-plus-function elements, if any, in the claims below are intended to include any structure, material, or acts for performing the functions in combination with other claimed elements as specifically claimed.

What is claimed is:

1. A piezo apparatus comprising:

(a) a piezo component having a top and a bottom surface and defining an opening;

(b) a metal plate having a top surface and bottom surface and defining a mist reservoir, the mist reservoir defining a plurality of holes orientated substantially perpendicular to the top surface of the metal plate;

(c) a floating washer; and (d) a floating washer holder;

wherein the top surface of the metal plate being adhered to the bottom surface of the piezo component, wherein the opening of the piezo component is located above the mist reservoir; and the floating washer and the floating washer holder being configured to support the metal plate while allowing the piezo component and the metal plate the freedom to effectively vibrate.

2. The apparatus of claim 1, the metal plate having a first thickness and the mist reservoir having a second thickness, wherein the second thickness is less than the first thickness.

3. The apparatus of claim 1, wherein the piezo component and the metal plate are disk shaped.

4. The apparatus of claim 1, wherein the metal plate is stainless steel.

5. The apparatus of claim 3, the metal plate having a first diameter and the piezo component having a second diameter, wherein the first diameter is larger than or approximately equal to the second diameter.

6. The apparatus of claim 1, wherein the piezo component comprises an electrode to receive a voltage.

7. The apparatus of claim 1, wherein the metal plate comprises an electrode to receive a voltage.

8. The apparatus of claim 1, wherein the mist reservoir is adapted to receive a wick.

9. The apparatus of claim 1, further comprising a cap, wherein the floating washer defines a vertical wall to enclose an aerosol component; the floating washer holder is adapted to hold the floating washer and the aerosol component; and the cap is adapted to engage the floating washer holder and springedly coupled to the floating washer and to conceal the aerosol component.

10. The apparatus of claim 9, wherein the floating washer has a general dome shape adapted to limit upward movement of the aerosol component.

11. The apparatus of claim 9, wherein the floating washer defines a depression for receiving a spring.

12. The apparatus of claim 9, further comprising a conical spring adapted to springedly couple the floating washer and the cap.

13. The apparatus of claim 9, wherein the mist reservoir is adapted to receive a wick and the aerosol component is adapted to contact the wick in response to receiving a voltage.

14. The apparatus of claim 9, wherein the floating washer holder has an "L" shaped cross section to support the vertical wall of the floating washer and an outer peripheral edge of the aerosol component.

15. The apparatus of claim 9, wherein the mist reservoir defines a plurality of holes in fluid communication with the opening defined by the piezo component such that fluid particles may pass through the aerosol component.

* * * * *